US007419223B2

(12) United States Patent
Seams

(10) Patent No.: US 7,419,223 B2
(45) Date of Patent: Sep. 2, 2008

(54) SYSTEM AND METHOD FOR ENHANCING PERMEABILITY OF A SUBTERRANEAN ZONE AT A HORIZONTAL WELL BORE

(75) Inventor: Douglas P. Seams, Calgary (CA)

(73) Assignee: CDX Gas, LLC, Houston, TX (US)

( * ) Notice: Subject to any disclaimer, the term of this patent is extended or adjusted under 35 U.S.C. 154(b) by 157 days.

(21) Appl. No.: 11/035,537

(22) Filed: Jan. 14, 2005

(65) Prior Publication Data

US 2005/0183859 A1 Aug. 25, 2005

Related U.S. Application Data

(63) Continuation-in-part of application No. 10/723,322, filed on Nov. 26, 2003, now Pat. No. 7,163,063.

(51) Int. Cl.
*E21C 37/00* (2006.01)

(52) U.S. Cl. ..... 299/2; 175/62

(58) Field of Classification Search ..... 299/2, 299/19; 175/57, 61, 62
See application file for complete search history.

(56) References Cited

U.S. PATENT DOCUMENTS

| | | | |
|---|---|---|---|
| 54,144 | A | 4/1866 | Hamar |
| 274,740 | A | 3/1883 | Douglass |
| 526,708 | A | 10/1894 | Horton |
| 639,036 | A | 12/1899 | Heald |
| 1,189,560 | A | 7/1916 | Gondos |
| 1,285,347 | A | 11/1918 | Otto |
| 1,467,480 | A | 9/1923 | Hogue |
| 1,485,615 | A | 3/1924 | Jones |
| 1,488,106 | A | 3/1924 | Fitzpatrick |
| 1,520,737 | A | 12/1924 | Wright |
| 1,674,392 | A | 6/1928 | Flansburg |
| 1,777,961 | A | 10/1930 | Capeliuschnicoff |
| 2,018,285 | A | 10/1935 | Schweitzer et al. |
| 2,069,482 | A | 2/1937 | Seay |
| 2,150,228 | A | 3/1939 | Lamb |
| 2,169,718 | A | 8/1939 | Böll et al. |
| 2,335,085 | A | 11/1943 | Roberts |

(Continued)

FOREIGN PATENT DOCUMENTS

| | | |
|---|---|---|
| CA | 2 278 735 | 1/1998 |

(Continued)

OTHER PUBLICATIONS

McCray, Arthur, et al., "*Oil Well Drilling Technology*," University of Oklahoma Press, 1959, Title Page, Copyright Page and pp. 315-319 (7 pages).

(Continued)

*Primary Examiner*—William P Neuder
(74) *Attorney, Agent, or Firm*—Fish & Richardson P.C.

(57) ABSTRACT

A method and system for enhancing permeability of a subterranean zone at a horizontal well bore includes determining a drilling profile for the horizontal well bore. At least one characteristic of the drilling profile is selected to aid in stabilizing the horizontal well bore during drilling. A liner is inserted into the horizontal well bore. The well bore is collapsed to increase permeability of the subterranean zone at the horizontal well bore.

10 Claims, 6 Drawing Sheets

U.S. PATENT DOCUMENTS

| | | | |
|---|---|---|---|
| 2,450,223 | A | 9/1948 | Barbour |
| 2,490,350 | A | 12/1949 | Grable |
| 2,679,903 | A | 6/1954 | McGowen, Jr. et al. |
| 2,726,063 | A | 12/1955 | Ragland et al. |
| 2,726,847 | A | 12/1955 | McCune et al. |
| 2,783,018 | A | 2/1957 | Lytle |
| 2,847,189 | A | 8/1958 | Shook |
| 2,911,008 | A | 11/1959 | Du Bois |
| 2,980,142 | A | 4/1961 | Turak |
| 3,208,537 | A | 9/1965 | Scarborough |
| 3,347,595 | A | 10/1967 | Dahms et al. |
| 3,443,648 | A | 5/1969 | Howard |
| 3,473,571 | A | 10/1969 | Dugay |
| 3,503,377 | A | 3/1970 | Beatenbough et al. |
| 3,528,516 | A | 9/1970 | Brown |
| 3,530,675 | A | 9/1970 | Turzillo |
| 3,684,041 | A | 8/1972 | Kammerer, Jr. et al. |
| 3,692,041 | A | 9/1972 | Bondi |
| 3,757,876 | A | 9/1973 | Pereau |
| 3,757,877 | A | 9/1973 | Leathers |
| 3,800,830 | A | 4/1974 | Etter |
| 3,809,519 | A | 5/1974 | Garner |
| 3,825,081 | A | 7/1974 | McMahon |
| 3,828,867 | A | 8/1974 | Elwood |
| 3,874,413 | A | 4/1975 | Valdez |
| 3,887,008 | A | 6/1975 | Canfield |
| 3,902,322 | A | 9/1975 | Watanabe |
| 3,907,045 | A | 9/1975 | Dahl et al. |
| 3,934,649 | A | 1/1976 | Pasini, III et al. |
| 3,957,082 | A | 5/1976 | Fuson et al. |
| 3,961,824 | A | 6/1976 | Van Eek et al. |
| 4,011,890 | A | 3/1977 | Andersson |
| 4,022,279 | A | 5/1977 | Driver |
| 4,037,658 | A | 7/1977 | Anderson |
| 4,073,351 | A | 2/1978 | Baum |
| 4,089,374 | A | 5/1978 | Terry |
| 4,116,012 | A | 9/1978 | Abe et al. |
| 4,134,463 | A | 1/1979 | Allen |
| 4,156,437 | A | 5/1979 | Chivens et al. |
| 4,169,510 | A | 10/1979 | Meigs |
| 4,189,184 | A | 2/1980 | Green |
| 4,194,580 | A | 3/1980 | Messenger |
| 4,220,203 | A | 9/1980 | Steeman |
| 4,221,433 | A | 9/1980 | Jacoby |
| 4,224,989 | A | 9/1980 | Blount |
| 4,245,699 | A | 1/1981 | Steeman |
| 4,257,650 | A | 3/1981 | Allen |
| 4,278,137 | A | 7/1981 | Van Eek |
| 4,283,088 | A | 8/1981 | Tabakov et al. |
| 4,296,785 | A | 10/1981 | Vitello et al. |
| 4,299,295 | A | 11/1981 | Gossard |
| 4,303,127 | A | 12/1981 | Freel et al. |
| 4,303,274 | A | 12/1981 | Thakur |
| 4,305,464 | A | 12/1981 | Masszi |
| 4,312,377 | A | 1/1982 | Knecht |
| 4,317,492 | A | 3/1982 | Summers et al. |
| 4,328,577 | A | 5/1982 | Abbott et al. |
| 4,333,539 | A | 6/1982 | Lyons et al. |
| 4,366,988 | A | 1/1983 | Bodine |
| 4,372,398 | A | 2/1983 | Kuckes |
| 4,386,665 | A | 6/1983 | Dellinger |
| 4,390,067 | A | 6/1983 | Willman |
| 4,396,076 | A | 8/1983 | Inoue |
| 4,397,360 | A | 8/1983 | Schmidt |
| 4,401,171 | A | 8/1983 | Fuchs |
| 4,407,376 | A | 10/1983 | Inoue |
| 4,437,706 | A | 3/1984 | Johnson |
| 4,442,896 | A | 4/1984 | Reale et al. |
| 4,494,616 | A | 1/1985 | McKee |
| 4,512,422 | A | 4/1985 | Knisley |
| 4,519,463 | A | 5/1985 | Schuh |
| 4,527,639 | A | 7/1985 | Dickinson, III et al. |
| 4,532,986 | A | 8/1985 | Mims et al. |
| 4,544,037 | A | 10/1985 | Terry |
| 4,558,744 | A | 12/1985 | Gibb |
| 4,565,252 | A | 1/1986 | Campbell et al. |
| 4,573,541 | A | 3/1986 | Josse et al. |
| 4,599,172 | A | 7/1986 | Gardes |
| 4,600,061 | A | 7/1986 | Richards |
| 4,605,076 | A | 8/1986 | Goodhart |
| 4,611,855 | A | 9/1986 | Richards |
| 4,618,009 | A | 10/1986 | Carter et al. |
| 4,638,949 | A | 1/1987 | Mancel |
| 4,646,836 | A | 3/1987 | Goodhart |
| 4,651,836 | A | 3/1987 | Richards et al. |
| 4,674,579 | A | 6/1987 | Geller et al. |
| 4,702,314 | A | 10/1987 | Huang et al. |
| 4,705,431 | A | 11/1987 | Gadelle et al. |
| 4,715,440 | A | 12/1987 | Boxell et al. |
| 4,754,819 | A | 7/1988 | Dellinger |
| 4,756,367 | A | 7/1988 | Puri et al. |
| 4,763,734 | A | 8/1988 | Dickinson et al. |
| 4,773,488 | A | 9/1988 | Bell et al. |
| 4,830,105 | A | 5/1989 | Petermann |
| 4,830,110 | A | 5/1989 | Perkins |
| 4,836,611 | A | 6/1989 | El-Saie |
| 4,842,081 | A | 6/1989 | Parant |
| 4,844,182 | A | 7/1989 | Tolle |
| 4,852,666 | A | 8/1989 | Brunet et al. |
| 4,883,122 | A | 11/1989 | Puri et al. |
| 4,929,348 | A | 5/1990 | Rice |
| 4,978,172 | A | 12/1990 | Schwoebel et al. |
| 5,016,710 | A | 5/1991 | Renard et al. |
| 5,035,605 | A | 7/1991 | Dinerman et al. |
| 5,036,921 | A | 8/1991 | Pittard et al. |
| 5,074,360 | A | 12/1991 | Guinn |
| 5,074,365 | A | 12/1991 | Kuckes |
| 5,074,366 | A | 12/1991 | Karlsson et al. |
| 5,082,054 | A | 1/1992 | Kiamanesh |
| 5,099,921 | A | 3/1992 | Puri et al. |
| 5,111,893 | A | 5/1992 | Kvello-Aune |
| 5,135,058 | A | 8/1992 | Millgard et al. |
| 5,148,875 | A | 9/1992 | Karlsson et al. |
| 5,165,491 | A | 11/1992 | Wilson |
| 5,168,942 | A | 12/1992 | Wydrinski |
| 5,174,374 | A | 12/1992 | Hailey |
| 5,193,620 | A | 3/1993 | Braddick |
| 5,194,859 | A | 3/1993 | Warren |
| 5,197,553 | A | 3/1993 | Leturno |
| 5,197,783 | A | 3/1993 | Theimer et al. |
| 5,199,496 | A | 4/1993 | Redus et al. |
| 5,201,817 | A | 4/1993 | Hailey |
| 5,217,076 | A | 6/1993 | Masek |
| 5,240,350 | A | 8/1993 | Yamaguchi et al. |
| 5,242,017 | A | 9/1993 | Hailey |
| 5,242,025 | A | 9/1993 | Neill et al. |
| 5,246,273 | A | 9/1993 | Rosar |
| 5,255,741 | A | 10/1993 | Alexander |
| 5,271,472 | A | 12/1993 | Leturno |
| 5,289,881 | A | 3/1994 | Schuh |
| 5,301,760 | A | 4/1994 | Graham |
| 5,363,927 | A | 11/1994 | Frank |
| 5,385,205 | A | 1/1995 | Hailey |
| 5,394,950 | A | 3/1995 | Gardes |
| 5,402,851 | A | 4/1995 | Baiton |
| 5,411,082 | A | 5/1995 | Kennedy |
| 5,411,085 | A | 5/1995 | Moore et al. |
| 5,411,088 | A | 5/1995 | LeBlanc et al. |
| 5,411,104 | A | 5/1995 | Stanley |
| 5,411,105 | A | 5/1995 | Gray |
| 5,419,396 | A | 5/1995 | Palmer et al. |
| 5,431,220 | A | 7/1995 | Lennon et al. |
| 5,435,400 | A | 7/1995 | Smith |
| 5,447,416 | A | 9/1995 | Wittrisch |

| | | | | |
|---|---|---|---|---|
| 5,450,902 | A | | 9/1995 | Matthews |
| 5,454,419 | A | | 10/1995 | Vloedman |
| 5,458,209 | A | | 10/1995 | Hayes et al. |
| 5,462,116 | A | | 10/1995 | Carroll |
| 5,462,120 | A | | 10/1995 | Gondouin |
| 5,469,155 | A | | 11/1995 | Archambeault et al. |
| 5,477,923 | A | | 12/1995 | Jordan, Jr. et al. |
| 5,485,089 | A | | 1/1996 | Kuckes |
| 5,494,121 | A | | 2/1996 | Nackerud |
| 5,499,687 | A | | 3/1996 | Lee |
| 5,501,273 | A | | 3/1996 | Puri |
| 5,501,279 | A | | 3/1996 | Garg et al. |
| 5,533,573 | A | * | 7/1996 | Jordan et al. ..... 166/313 |
| 5,562,159 | A | | 10/1996 | Smith et al. |
| 5,584,605 | A | | 12/1996 | Beard et al. |
| 5,613,242 | A | | 3/1997 | Oddo |
| 5,615,739 | A | | 4/1997 | Dallas |
| 5,653,286 | A | | 8/1997 | McCoy et al. |
| 5,655,605 | A | | 8/1997 | Matthews |
| 5,669,444 | A | | 9/1997 | Riese et al. |
| 5,680,901 | A | | 10/1997 | Gardes |
| 5,690,390 | A | | 11/1997 | Bithell |
| 5,706,871 | A | | 1/1998 | Andersson et al. |
| 5,720,356 | A | | 2/1998 | Gardes |
| 5,727,629 | A | | 3/1998 | Blizzard, Jr. et al. |
| 5,735,350 | A | | 4/1998 | Longbottom et al. |
| 5,771,976 | A | | 6/1998 | Talley |
| 5,775,433 | A | | 7/1998 | Hammett et al. |
| 5,785,133 | A | | 7/1998 | Murray et al. |
| 5,832,958 | A | | 11/1998 | Cheng |
| 5,853,054 | A | | 12/1998 | McGarian et al. |
| 5,853,056 | A | | 12/1998 | Landers |
| 5,853,224 | A | | 12/1998 | Riese |
| 5,863,283 | A | | 1/1999 | Gardes |
| 5,868,202 | A | | 2/1999 | Hsu |
| 5,868,210 | A | | 2/1999 | Johnson et al. |
| 5,879,057 | A | | 3/1999 | Schwoebel et al. |
| 5,884,704 | A | | 3/1999 | Longbottom et al. |
| 5,917,325 | A | | 6/1999 | Smith |
| 5,934,390 | A | | 8/1999 | Uthe |
| 5,938,004 | A | | 8/1999 | Roberts et al. |
| 5,941,308 | A | | 8/1999 | Malone et al. |
| 5,957,539 | A | | 9/1999 | Durup et al. |
| 5,971,074 | A | | 10/1999 | Longbottom et al. |
| 6,012,520 | A | | 1/2000 | Yu et al. |
| 6,015,012 | A | | 1/2000 | Reddick |
| 6,024,171 | A | | 2/2000 | Montgomery et al. |
| 6,050,335 | A | | 4/2000 | Parsons |
| 6,056,059 | A | | 5/2000 | Ohmer |
| 6,065,550 | A | | 5/2000 | Gardes |
| 6,119,771 | A | | 9/2000 | Gano et al. |
| 6,123,159 | A | | 9/2000 | Brookey et al. |
| 6,135,208 | A | | 10/2000 | Gano et al. |
| 6,179,054 | B1 | | 1/2001 | Stewart |
| 6,209,636 | B1 | | 4/2001 | Roberts et al. |
| 6,280,000 | B1 | | 8/2001 | Zupanick |
| 6,349,769 | B1 | | 2/2002 | Ohmer |
| 6,357,523 | B1 | | 3/2002 | Zupanick |
| 6,357,530 | B1 | | 3/2002 | Kennedy et al. |
| 6,425,448 | B1 | | 7/2002 | Zupanick et al. |
| 6,439,320 | B2 | | 8/2002 | Zupanick |
| 6,450,256 | B2 | | 9/2002 | Mones |
| 6,454,000 | B1 | | 9/2002 | Zupanick |
| 6,457,540 | B2 | | 10/2002 | Gardes |
| 6,478,085 | B2 | | 11/2002 | Zupanick |
| 6,497,556 | B2 | | 12/2002 | Zupanick et al. |
| 6,561,277 | B2 | | 5/2003 | Algeory |
| 6,561,288 | B2 | | 5/2003 | Zupanick |
| 6,566,649 | B1 | | 5/2003 | Mickael |
| 6,571,888 | B2 | | 6/2003 | Comeau et al. |
| 6,575,235 | B2 | | 6/2003 | Zupanick et al. |
| 6,577,129 | B1 | | 6/2003 | Thompson et al. |
| 6,585,061 | B2 | | 7/2003 | Radzinski et al. |
| 6,590,202 | B2 | | 7/2003 | Mickael |
| 6,591,903 | B2 | | 7/2003 | Ingle et al. |
| 6,598,686 | B1 | | 7/2003 | Zupanick |
| 6,604,580 | B2 | | 8/2003 | Zupanick et al. |
| 6,604,910 | B1 | | 8/2003 | Zupanick |
| 6,607,042 | B2 | | 8/2003 | Hoyer et al. |
| 6,636,159 | B1 | | 10/2003 | Winnacker |
| 6,639,210 | B2 | | 10/2003 | Odom et al. |
| 6,646,441 | B2 | | 11/2003 | Thompson et al. |
| 6,653,839 | B2 | | 11/2003 | Yuratich et al. |
| 6,662,870 | B1 | | 12/2003 | Zupanick et al. |
| 6,668,918 | B2 | | 12/2003 | Zupanick |
| 6,679,322 | B1 | | 1/2004 | Zupanick |
| 6,681,855 | B2 | | 1/2004 | Zupanick et al. |
| 6,688,388 | B2 | | 2/2004 | Zupanick |
| 6,708,764 | B2 | | 3/2004 | Zupanick |
| 6,725,922 | B2 | | 4/2004 | Zupanick |
| 6,732,792 | B2 | | 5/2004 | Zupanick |
| 6,745,855 | B2 | | 6/2004 | Gardes |
| 6,758,289 | B2 | | 7/2004 | Kelly et al. |
| 7,037,881 | B2 | | 5/2006 | Growcock et al. |
| 7,063,164 | B2 | | 6/2006 | Hilsman et al. |
| 2002/0074120 | A1 | | 6/2002 | Scott |
| 2002/0096336 | A1 | | 7/2002 | Zupanick et al. |
| 2002/0189801 | A1 | | 12/2002 | Zupanick et al. |
| 2003/0066686 | A1 | | 4/2003 | Conn |
| 2003/0075334 | A1 | | 4/2003 | Haugen et al. |
| 2003/0217842 | A1 | | 11/2003 | Zupanick et al. |
| 2004/0007389 | A1 | | 1/2004 | Zupanick |
| 2004/0007390 | A1 | | 1/2004 | Zupanick |
| 2004/0035582 | A1 | | 2/2004 | Zupanick |
| 2004/0050552 | A1 | | 3/2004 | Zupanick |
| 2004/0050554 | A1 | | 3/2004 | Zupanick et al. |
| 2004/0055787 | A1 | | 3/2004 | Zupanick |
| 2004/0118558 | A1 | | 6/2004 | Rial et al. |
| 2004/0149428 | A1 | * | 8/2004 | Kvernstuen et al. ..... 166/65.1 |
| 2005/0109505 | A1 | | 5/2005 | Seams |
| 2006/0006004 | A1 | | 1/2006 | Terry et al. |
| 2006/0131076 | A1 | * | 6/2006 | Zupanick ..... 175/57 |
| 2006/0201714 | A1 | | 9/2006 | Seams et al. |

FOREIGN PATENT DOCUMENTS

| | | | |
|---|---|---|---|
| CH | 653 741 | | 1/1986 |
| EP | 0 875 661 | A1 | 11/1998 |
| EP | 0 952 300 | A1 | 10/1999 |
| GB | 2 255 033 | | 10/1992 |
| GB | 2 297 988 | | 8/1996 |
| GB | 2 347 157 | | 8/2002 |
| SU | 750108 | | 6/1975 |
| SU | 1448078 | A1 | 3/1987 |
| SU | 1770570 | A1 | 3/1990 |
| WO | WO 94 21889 | | 9/1994 |
| WO | WO 98/35133 | | 8/1998 |
| WO | WO 99/60248 | | 11/1999 |
| WO | WO 00/31376 | | 6/2000 |
| WO | WO 00/79099 | A1 | 12/2000 |
| WO | WO 01/414620 | | 6/2001 |
| WO | WO 01/51760 | A2 | 7/2001 |
| WO | WO 01/51760 | A3 | 7/2001 |
| WO | WO 02/18738 | | 3/2002 |
| WO | WO 02/059455 | A1 | 8/2002 |
| WO | WO 02/061238 | | 8/2002 |
| WO | WO 03/102348 | | 12/2003 |

OTHER PUBLICATIONS

Berger, Bill, et al., "*Modern Petroleum: A Basic Primer of the Industry*," PennWell Books, 1978, Title Page, Copyright Page, and pp. 106-108 (5 pages).

Jones, Arfon H., et al., "*A Review of the Physical and Mechanical Properties of Coal with Implications for Coal-Bed Methane Well Completion and Production*," Rocky Mountain Association of Geologists, 1988, pp. 169-181 (13 pages).

Hartman, Howard L., et al., "*SME Mining Engineering Handbook*;" Society for Mining, Metallurgy, and Exploration, Inc., 2nd Edition, vol. 2, 1992, Title Page, pp. 1946-1950 (6 pages).
Hassan, Dave, et al., "*Multi-Lateral Technique Lowers Drilling Costs, Provides Environmental Benefits*, " Drilling Technology, Oct. 1999, pp. 41-47 (7 pages).
Ramaswamy, Gopal, "*Production History Provides CBM Insights*," Oil & Gas Journal, Apr. 2, 2001, pp. 49-50 and 52 (3 pages).
Chi, Weiguo, et al., "*Feasibility of Coalbed Methane Exploitation in China*," Horizontal Well Technology, Sep. 2001, Title Page and p. 74 (2 pages).
Nackerud Product Description, Harvest Tool Company, LLC, Received Sep. 27, 2001, 1 page.
Ramaswamy, Gopal, "*Advances Key For Coalbed Methane*," The American Oil & Gas Reporter, Oct. 2001, Title Page and pp. 71 and 73 (3 pages).
Stevens, Joseph C., "*Horizontal Applications for Coal Bed Methane Recovery*," Strategic Research Institute, 3rd Annual Coalbed and Coal Mine Methane Conference, Slides, Mar. 25, 2002, Title Page, Introduction Page and pp. 1-10 (13 pages).
Stayton, R.J. "Bob", "*Horizontal Wells Boost CBM Recovery*," Special Report: Horizontal and Directional Drilling, The American Oil and Gas Reporter, Aug. 2002, pp. 71, 73-75 (4 pages).
Jackson, P., et al., "Reducing Long Term Methane Emissions Resulting from Coal Mining," Energy Convers. Mgmt, vol. 37, Nos. 6-8, 1996, pp. 801-806, (6 pages).
Eaton, Susan, "Reversal of Fortune: Vertical and Horizontal Well Hybrid Offers Longer Field Life," New Technology Magazine, Sep. 2002, pp. 30-31 (2 pages).
Mahony, James, "A Shadow of Things to Come," New Technology Magazine, Sep. 2002, pp. 28-29 (2 pages).
Documents Received from Third Party, Great Lakes Directional Drilling, Inc., Sep. 12, 2002, (12 pages).
Taylor, Robert W., et al. "*Multilateral Technologies Increase Operational Efficiencies in Middle East*," Oil and Gas Journal, Mar. 16, 1998, pp. 76-80 (5 pages).
Pasiczynk, Adam, "Evolution Simplifies Multilateral Wells," Directional Drilling, Jun. 2000, pp. 53-55 (3 pages).
Bell, Steven S. "*Multilateral System with Full Re-Entry Access Installed*," World Oil, Jun. 1, 1996, p. 29 (1 page).
Breant, Pascal, "*Des Puits Branches, Chez Total : les puits multi drains*, " Total Exporation Production, Jan. 1999, 11 pages, including translation.
Chi, Weiguo, "A feasible discussion on exploitation coalbed methane through Horizontal Network Drilling in China," SPE 64709, Society of Petroleum Engineers (SPE International), Nov. 7, 2000, 4 pages.
Palmer, Ian D., et al., "*Coalbed Methane Well Completions and Stimulations*," Chapter 14, Hydrocarbons From Coal, American Association of Petroleum Geologists, 1993, pp. 303-339.
Diamond et al., U.S. Patent Application entitled "Method and System for Removing Fluid From a Subterranean Zone Using an Enlarged Cavity," U.S. Appl. No. 10/264,535, Oct. 3, 2002 (37 pages).
Notification of Transmittal of the International Search Report or the Declaration (PCT Rule 44.1) (3 pages) and International Search Report (4 pages) re International Application No. PCT/US 03/21626 mailed Nov. 6, 2003.
Notification of Transmittal of the International Search Report or the Declaration (PCT Rule 44.1) (3 pages) and International Search Report (5 pages) re International Application No. PCT/US 03/21627 mailed Nov. 5, 2003.
Notification of Transmittal of the International Search Report or the Declaration (PCT Rule 44.1) (3 pages) and International Search Report (4 pages) re International Application No. PCT/US 03/21628 mailed Nov. 4, 2003.
Notification of Transmittal of the International Search Report or the Declaration (PCT Rule 44.1) (3 pages) and International Search Report (5 pages) re International Application No. PCT/US 03/21750 mailed Dec. 5, 2003.
Notification of Transmittal of the International Search Report or the Declaration (PCT Rule 44.1) (3 pages) and International Search Report (3 pages) re International Application No. PCT/US 03/28137 mailed Dec. 19, 2003.
Notification of Transmittal of the International Search Report or the Declaration (PCT Rule 44.1) (3 pages) and International Search Report (5 pages) re International Application No. PCT/US 03/26124 mailed Feb. 4, 2004.
Smith, Maurice, "Chasing Unconventional Gas Unconventionally," CBM Gas Technology, New Technology Magazine, Oct./Nov. 2003, Title Page and pp. 1-4 (5 pages).
Gardes, Robert, "*A New Direction in Coalbed Methane and Shale Gas Recovery*," believed to have been first received at the Canadian Institute Coalbed Methane Symposium conference on Jun. 17, 2002, 7 pages.
Gardes, Robert, "Under-Balanced Multi-Lateral Drilling for Unconventional Gas Recovery," (to the best of Applicants' recollection, first received at The Unconventional Gas Revolution conference on Dec. 9, 2003, 38 pages.
Boyce, Richard G., "*High Resolution Selsmic Imaging Programs for Coalbed Methane Development*," (to the best of Applicants' recollection, first received at The Unconventional Gas Revolution conference on Dec. 10, 2003), 29 pages.
Mazzella, Mark, et al., "*Well Control Operations on a Multiwell Platform Blowout*," WorldOil.com—Online Magazine Article, vol. 22, Part 1—pp. 1-7, Jan. 2001, Part II, Feb. 2001, pp. 1-13 (20 pages).
Vector Magnetics, LLC, Case History, California, May 1999, "*Successful Kill of a Surface Blowout*," 1999, pp. 1-12.
Cudd Pressure Control, Inc, "*Successful Well Control Operations—A Case Study: Surface and Subsurface Well Intervention on a Multi-Well Offshore Platform Blowout and Fire," 2000, pp. 1-17, http://www.cuddwellcontrol.com/literature/successful/successful*_well.htm.
Purl, R., et al., "Damage to Coal Permeability During Hydraulic Fracturing," SPE 21813, 1991, Title Page and pp. 109-115 (8 pages).
U.S. Dept. of Energy—Office of Fossil Energy, "*Multi-Seam Well Completion Technology: Implications for Powder River Basin Coalbed Methane Production*," Sep. 2003, pp. 1-100, A-1 through A-10 (123 pages).
U.S. Dept. of Energy—Office of Fossil Energy, "*Powder River Basin Coalbed Methane Development and Produced Water Management Study*," Nov. 2002, pp. 1-111, A-1 through A-14 (123 pages).
Zupanick, et al., U.S. Patent Application entitled "Method and System for Underground Treatment of Materials," U.S. Appl. No. 10/142,817, filed May 8, 2002 (55 pages).
Zupanick , U.S. Patent Application entitled "Slant Entry Well System and Method," U.S. Appl. No. 10/004,316, filed Oct. 30, 2001 (36 pages).
Zupanick, et al, U.S. Patent Application entitled "Method and System for Controlling Pressure in a Dual Well System," U.S. Appl. No. 10/244,082, filed Sep. 12, 2002 (30 pages).
Zupanick, U.S. Patent Application entitled "Method of Drilling Lateral Wellbores From a Slant Well Without Utilizing a Whipstock," U.S. Appl. No. 10/267,426, filed Oct. 8, 2002 (24 pages).
Zupanick, et al., U.S. Patent Application entitled "Method and System for Recirulating Fluid in a Well System," U.S. Appl. No. 10/457,103, filed Jun. 5, 2003 (41 pages).
Notification of Transmittal of the International Search Report or the Declaration (PCT Rule 44.1) (3 pages) and International Search Report (6 pages) re International Application No. PCT/US 03/28138 mailed Feb. 9, 2004.
Notification of Transmittal of the International Search Report or the Declaration (PCT Rule 44.1) (3 pages) and International Search Report (6 pages) re International Application No. PCT/US-03/30126 mailed Feb. 27, 2004.
Fletcher, Sam, "*Anadarko Cuts Route Under Canadian River Gorge*," Oil & Gas Journal, Jan. 5, 2004, pp. 28-30, (3 pages).
Kalinin, et al., Translation of Selected Pages from Ch. 4, Sections 4.1, 4.4, 4.4.1, 4.4.3, 11.2.2, 11.2.4 and 11.4, "*Drilling Inclined and Horizontal Well Bores*," Moscow, Nedra Publishers, 1997, 15 pages.
Arens, V. Zh., Translation of Selected Pages, "*Well-Drilling Recovery of Minerals*," Moscow, Nedra Publishers, 1986, 7 pages.
Santos, Helio, SPE, Impact Engineering Solutions and Jesus Olaya, Ecopetrol/ICP, "*No-Damage Drilling: How to Achieve this Challenging Goal?*," SPE 77189, Copyright 2002, presented at the IADC/SPE Asia Pacific Drilling Technology, Jakarta, Indonesia, Sep. 9-11, 2002, 10 pages.

Santos, Helio, SPE, Impact Engineering Solutions, "*Increasing Leakoff Pressure with New Class of Drilling Fluid*," SPE 78243, Copyright 2002, Presented at the SPE/ISRM Rock Mechanics Conference in Irving, Texas, Oct. 20-23, 2002, 7 pages.

Franck Labenski, Paul Reid, SPE, and Helio Santos, SPE, Impact Solutions Group, "*Drilling Fluids Approaches for Control of Wellbore Instability in Fractured Formations*," SPE/IADC 85304, Society of Petroleum Engineers, Copyright 2003, presented at the SPE/IADC Middle East Drilling Technology Conference & Exhibition in Abu Chabi, UAE, Oct. 20-22, 2003, 8 pages.

P. Reid, SPE, and H. Santos, SPE, Impact Solutions Group, "*Novel Drilling, Completion and Workover Fluids for Depleted Zones: Avoiding Losses, Formation Damage and Stuck Pipe*," SPE/IADC 85326, Society of Petroleum Engineers, Copyright 2003, presented at the SPE/IADC Middle East Drilling Conference & Exhibition in Abu Chabi, UAE, Oct. 20-22, 2003, 9 pages.

Craig C. White and Adrian P. Chesters, NAM; Catalin D. Ivan, Sven Maikranz and Rob Nouris, M-I L.L.C., "*Aphron-based drilling fluid: Novel technology for drilling depleted formations*," World Oil, Drilling Report Special Focus, Oct. 2003, 6 pages.

Notification of Transmittal of the International Search Report and the Written Opinion of the International Searching Authority, or the Declaration (3 pages), International Search Report (4 pages) and Written Opinion of the International Searching Authorit (PCT Rule 43bis.1) (4 pages) re International Application No. PCT/US 2004/036920 mailed Feb. 24, 2005.

Notification of Transmittal of International Preliminary Examination Report (6 pages) mailed Jan. 18, 2005 and Written Opinion (8 pages) mailed Aug. 25, 2004 for International Application No. PCT/US 03/030126.

Robert E. Snyder, "Drilling Advances," World Oil, Oct. 2003, 1 page.

Molvar, Erik M., "Drilling Smarter: Using Directional to Reduce Oil and Gas Impacts in the Intermountain West," Prepared by Biodiversity Conservation Alliance, Report issued Feb. 18, 2003, 34 pages.

King, Robert F., "Drilling Sideways—A review of Horizontal Well Technology and Its Domestic Application," DOE/EIA-TR-0565, U.S. Department of Energy, Apr. 1993, 30 pages.

McLennan, John, et al., "Underbalanced Drilling Manual," Gas Research Institute, Chicago, Illinois, GRI Reference No. GRI-97/0236, copyright 1997, 502 pages.

David C. Oyler and William P. Diamond, "Drilling a Horizontal Coalbed Methane Drainage System From a Directional Surface Borehole," PB82221516, National Technical Information Service, Bureau of Mines, Pittsburgh, PA, Pittsburgh Research Center, Apr. 1982, 56 pages.

K&M Technology Group—Case Studies, "Improving Your Drilling Performance," Website: http://www.kmtechnology.com/projects/case_studies.asp, printed Mar. 17, 2005, 4 pages.

U.S. Environmental Protection Agency, "Directional Drilling Technology," prepared for the EPA by Advanced Resources International under Contract 68-W-00-094, Coalbed Methane Outreach Program (CMOP), Website: http://search.epa.gov/s97is.vts, printed Mar. 17, 2005, 13 pages.

Calendar of Events—Conferences, "Unconventional Gas: Key to Energy Supply," 6th Annual Unconventional Gas Conference, Calgary, Alberta, Canada, Website: http://www.csug.ca/cal/calc0401a.html, Nov. 17-19, 2004, 7 pages.

Information regarding San Juan 32-5 Unit, Well No. 100, completed on or about Sep. 1, 1989 (44 pages).

Information regarding Rosa Unit, Well No. 381, completed on or about Dec. 1, 2002 (25 pages).

Information regarding Rosa Unit, Well No. 379, completed on or about Sep. 1, 2002 (26 pages).

Information regarding Rosa Unit, Well No. 371, completed on or about Sep. 1, 2002 (30 pages).

Information regarding Rosa Unit, Well No. 273A, completed on or about Dec. 1, 2003 (19 pages).

Information regarding Vandewart B, Well No. 3S, completed on or about Aug. 1, 2004 (22 pages).

William P. Diamond, "Methane Control for Underground Coal Mines,"IC-9395, Bureau of Mines Information Circular, United States Department of the Interior, 1994 (51 pages).

Information regarding Anderson, Well No. 1R, publication date believed to be Jun. 28, 2002-Sep. 5, 2002 (35 pages).

Information regarding Penrose, Well No. 1R, publication date believed to be Feb. 8, 2002-Jul. 18, 2003 (40 pages).

Information regarding Rosa Unit, Well No. 361, publication date believed to be Apr. 27, 2001-Aug. 12, 2003 (28 pages).

Information regarding Sunray H, Well No. 201, publication date believed to be Aug. 5, 1988-May 2, 1989 (21 pages).

Zupanick, U.S. Patent Application entitled, "Accessing Subterranean Resources by Formation Collapse," U.S. Appl. No. 11/019,757, filed Dec. 21, 2004 (41 pages).

Pratt et al., U.S. Patent Application entitled, "Drilling Normally to Sub-Normally Pressured Formations," U.S. Appl. No. 11/141,459, filed May 31, 2005 (31 pages).

Oil and Gas Information Database Project Workshop Notes, Mar. 8, 2005, 14 pages.

P. Reid, H. Santos and F. Labenski, "*Associative Polymers for Invasion Control in Water- and Oil-based Muds and in Cementing Spacers: Laboratory and Field Case Histories*," American Assocation of Drilling Engineers, AADE-04-DF-HO-33, prepared for presentation at the AADE 2004 Drilling Fluids Conference, Apr. 6-7, 2004, 14 pages.

Notification of Transmittal of International Search Report and Written Opinion of the International Searching Authority, or the Declaration (2 pages), International Search Report (3 pages), and Written Opinion of the International Searching Authority (7 pages) for International Application No. PCT/US2006/001403 mailed May 19, 2006.

Notification of Transmittal of the International Preliminary Report on Patentability (1 page) and International Preliminary Report on Patentability (9 pages) for International Application No. PCT/US2006/001403 mailed Jan. 24, 2007.

Arnold Wong and M.J. Arco, "Use of Hollow Glass Bubbles as a Density Reducing Agent for Drilling," Paper No. 2001-31, CADE/CAODC Drilling Conference, Oct. 23-24, 2001 Calgary, Alberta Canada, 14 pages.

C.P. Tan, et al., "Wellbore Stability of Extended Reach Wells in an Oil Field in Sarawak Basin, South China Sea," Society of Petroleum Engineers, SPE 88609, Copyright 2004, 11 pages.

* cited by examiner

SYSTEM AND METHOD FOR ENHANCING PERMEABILITY OF A SUBTERRANEAN ZONE AT A HORIZONTAL WELL BORE

RELATED APPLICATION

This application is a continuation-in-part of, and therefore claims priority from, U.S. patent application Ser. No. 10/723,322, filed on Nov. 26, 2003 now U.S. Pat. No. 7,163,063.

TECHNICAL FIELD

This disclosure relates generally to the field of recovery of subterranean resources, and more particularly to a system and method for enhancing permeability of a subterranean zone at a well bore.

BACKGROUND

Reservoirs are subterranean formations of rock containing oil, gas, and/or water. Unconventional reservoirs include coal and shale formations containing gas and, in some cases, water. A coal bed, for example, may contain natural gas and water.

Coal bed methane (CBM) is often produced using vertical wells drilled from the surface into a coal bed. Vertical wells drain a very small radius of methane gas in low permeability formations. As a result, after gas in the vicinity of the vertical well has been produced, further production from the coal seam through the vertical well is limited.

To enhance production through vertical wells, the wells have been fractured using conventional and/or other stimulation techniques. Horizontal patterns have also been formed in coal seams to increase and/or accelerate gas production.

SUMMARY

A system and method for enhancing permeability of a subterranean zone at a horizontal well bore are provided. In one embodiment, the method determines a drilling profile for drilling a horizontal well in a subterranean zone. At least one characteristic of the drilling profile is selected to aid in well bore stability during drilling. A liner is inserted into the horizontal well bore. The horizontal well bore is collapsed around the liner.

More specifically, in accordance with a particular embodiment, a non-invasive drilling fluid may be used to control a filter cake formed on the well bore during drilling. In these and other embodiments, the filter cake may seal the boundary of the well bore.

In another embodiment, a method is provided for obtaining resources from a coal seam disposed between a first aquifer and/or a second aquifer. The method includes forming a well bore including a substantially horizontal well bore formed in the coal seam. The well bore may in certain embodiments be collapsed or spalled. The well bore may also or instead include one or more laterals.

Technical advantages of certain embodiments include providing a system and method for enhancing permeability of a subterranean zone at a well bore. In particular, a subterranean zone, such as a coal seam, may be collapsed around a liner to increase the localized permeability of the subterranean zone and thereby, resource production.

Another technical advantage of certain embodiments may be the use of non-invasive drilling fluid to create a filter cake in the well bore. The filter cake may seal the well bore and allow stability to be controlled. For example, negative pressure differential may be used to instigate collapse of the well bore. A positive pressure differential may be maintained during drilling and completion to stabilize the well bore.

Other technical advantages will be readily apparent to one skilled in the art from the following figures, description, and claims. Moreover, while specific advantages have been enumerated above, various embodiments may include all, some, or none of the enumerated advantages.

DETAILED DESCRIPTION

Figure 1:
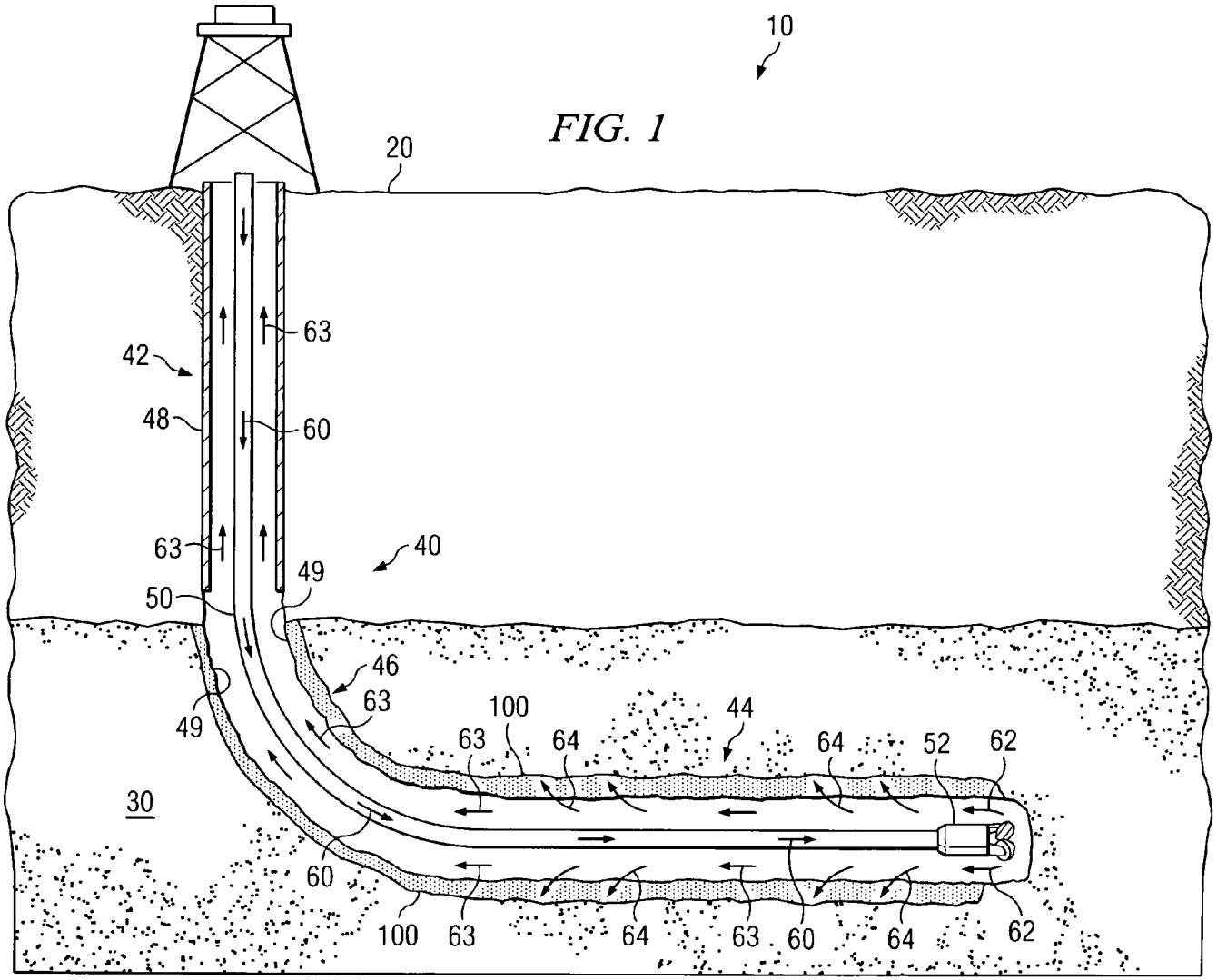
FIG. 1 illustrates one embodiment of drilling a well into a subterranean zone.

FIG. 1 illustrates an example system 10 during drilling of a well in a subterranean zone. As described in more detail below, localized permeability of the subterranean zone may be enhanced based on drilling, completion and/or production conditions and operations. Localized permeability is the permeability of all or part of an area around, otherwise about, or local to a well bore. Localized permeability may be enhanced by spalling or cleaving the subterranean zone around the well bore and/or collapsing the well bore. Cleaving refers to splitting or separating portions of the subterranean zone. Spalling refers to breaking portions of the subterranean zone into fragments and may be localized collapse, fracturing, splitting and/or shearing. The term spalling will hereinafter be used to collectively refer to spalling and/or cleaving. Collapse refers to portions of the subterranean zone falling downwardly or inwardly into the well bore or a caving in of the well bore from loss of support. Collapse will hereinafter be used to collectively refer to collapse and spalling.

In the illustrated embodiment, system 10 includes an articulated well bore 40 extending from surface 20 to penetrate subterranean zone 30. In particular embodiments, the subterranean zone 30 may be a coal seam. Subterranean zone 30, such as a coal seam, may be accessed to remove and/or produce water, hydrocarbons, and other fluids in the subterranean zone 30, to sequester carbon dioxide or other pollutants in the subterranean zone 30, and/or for other operations. Subterranean zone 30 may be a fractured or other shale or other suitable formation operable to collapse under one or more controllable conditions.

For ease of reference and purposes of example, subterranean zone 30 will be referred to as coal seam 30. However, it should be understood that the method and system for enhancing permeability may be implemented in any appropriate subterranean zone. In certain embodiments, the efficiency of gas production from coal seam 30 may be improved by collapsing the well bore 40 in the coal seam 30 to increase the localized permeability of the coal seam 30. The increased localized permeability provides more drainage surface area without hydraulically fracturing the coal seam 30. Hydraulic fracturing comprises pumping a fracturing fluid down-hole under high pressure, for example, 1000 psi, 5000 psi, 10,000 psi or more.

Although FIG. 1 illustrates an articulated well bore 40, system 10 may be implemented in substantially horizontal wells, slant wells, dual or multi-well systems or any other suitable types of wells or well systems. Well bore 40 may be drilled to intersect more natural passages and other fractures, such as "cleats" of a coal seam 30, that allow the flow of fluids from seam into well bore 40, thereby increasing the productivity of the well. In certain embodiments, articulated well bore 40 includes a vertical portion 42, a horizontal portion 44, and a curved or radiused portion 46 interconnecting the substantially vertical and substantially horizontal portions 42 and 44. The horizontal portion 44 may be substantially horizontal and/or in the seam of coal seam 30, may track the depth of the coal seam 30, may undulate in the seam or be otherwise suitably disposed in or about the coal seam 30. The vertical portion 42 of articulated well bore 40 may be substantially vertical and/or sloped and/or lined with a suitable casing 48.

Articulated well bore 40 is drilled using articulated drill string 50 that includes a suitable down-hole motor and drill bit 52. Well bore 40 may include a well bore pattern with a plurality of lateral or other horizontal well bores, as it discussed in more detail with respect to FIG. 2. In another embodiment, the well bore 40 may be a single bore without laterals.

During the process of drilling well bore 40, drilling fluid or mud is pumped down articulated drill string 50, as illustrated by arrows 60, and circulated out of drill string 50 in the vicinity of drill bit 52, as illustrated by arrows 62. The drilling fluid flows into the annulus between drill string 50 and well bore walls 49 where the drilling fluid is used to scour the formation and to remove formation cuttings and coal fines. The cuttings and coal fines (hereinafter referred to as "debris") are entrained in the drilling fluid, which circulates up through the annulus between the drill string 40 and the well bore walls 49, as illustrated by arrows 63, until it reaches surface 20, where the debris is removed from the drilling fluid and the fluid is re-circulated through well bore 40.

This drilling operation may produce a standard column of drilling fluid having a vertical height equal to the depth of the well bore 40 and produces a hydrostatic pressure on well bore 40 corresponding to the depth of well bore 40. Because coal seams, such as coal seam 30, tend to be porous, their formation pressure may be less than such hydrostatic pressure, even if formation water is also present in coal seam 30. Accordingly, when the full hydrostatic pressure is allowed to act on coal seam 30, the result may be a loss of drilling fluid and entrained debris into the cleats of the formation, as illustrated by arrows 64. Such a circumstance is referred to as an over-balanced drilling operation in which the hydrostatic fluid pressure in well bore 40 exceeds the pressure in the formation.

In certain embodiments, the drilling fluid may comprise a brine. The brine may be fluid produced from another well in the subterranean zone 30 or other zone. If brine loss exceeds supply during drilling, solids may be added to form a filter cake 100 along the walls of the well bore 40. Filter cake 100 may prevent or significantly restrict drilling fluids from flowing into coal seam 30 from the well bore 40. The filter cake 100 may also provide a pressure boundary or seal between coal seam 30 and well bore 40 which may allow hydrostatic pressure in the well bore 40 to be used to control stability of the well bore 40 to prevent or allow collapse. For example, during drilling, the filter cake 100 aids well bore stability by allowing the hydrostatic pressure to act against the walls of the well bore 40.

The depth of the filter cake 100 is dependent upon many factors including the composition of the drilling fluid. As described in more detail below, the drilling fluid may be selected or otherwise designed based on rock mechanics, pressure and other characteristics of the coal seam 30 to form a filter cake that reduces or minimizes fluid loss during drilling and/or to reduces or minimizes skin damage to the well bore 40.

The filter cake 100 may be formed with low-loss, ultra low-loss, or other non-invasive or other suitable drilling fluids. In one embodiment, the solids may comprise micelles that form microscopic spheres, rods, and/or plates in solutions. The micelles may comprise polymers with a range of water and oil solubilities. The micelles form a low permeability seal over pore throats of the coal seam 30 to greatly limit further fluid invasion or otherwise seal the coal seam boundary.

Figure 2:
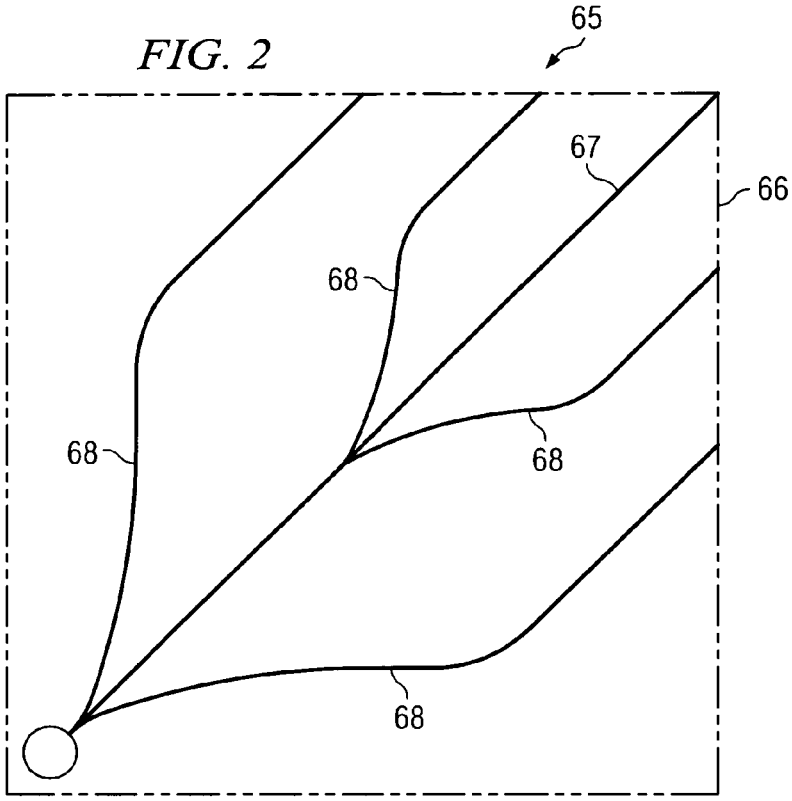
FIG. 2 illustrates one embodiment of a well bore pattern for the well of FIG. 1.

FIG. 2 illustrates an example of horizontal well bore pattern 65 for use in connection with well bore 40. In this embodiment, the pattern 65 may include a main horizontal well bore 67 extending diagonally across the coverage area 66. A plurality of lateral or other horizontal well bores 68 may extend from the main bore 67. The lateral bore 68 may mirror each other on opposite sides of the main bore 67 or may be offset from each other along the main bore 67. Each of the laterals 68 may be drilled at a radius off the main bore 67. The horizontal pattern 65 may be otherwise formed, may otherwise include a plurality of horizontal bores or may be omitted. For example, the pattern 65 may comprise a pinnate pattern. The horizontal bores may be bores that are fully or substantially in the coal seam 30, or horizontal and/or substantially horizontal.

Figure 3:
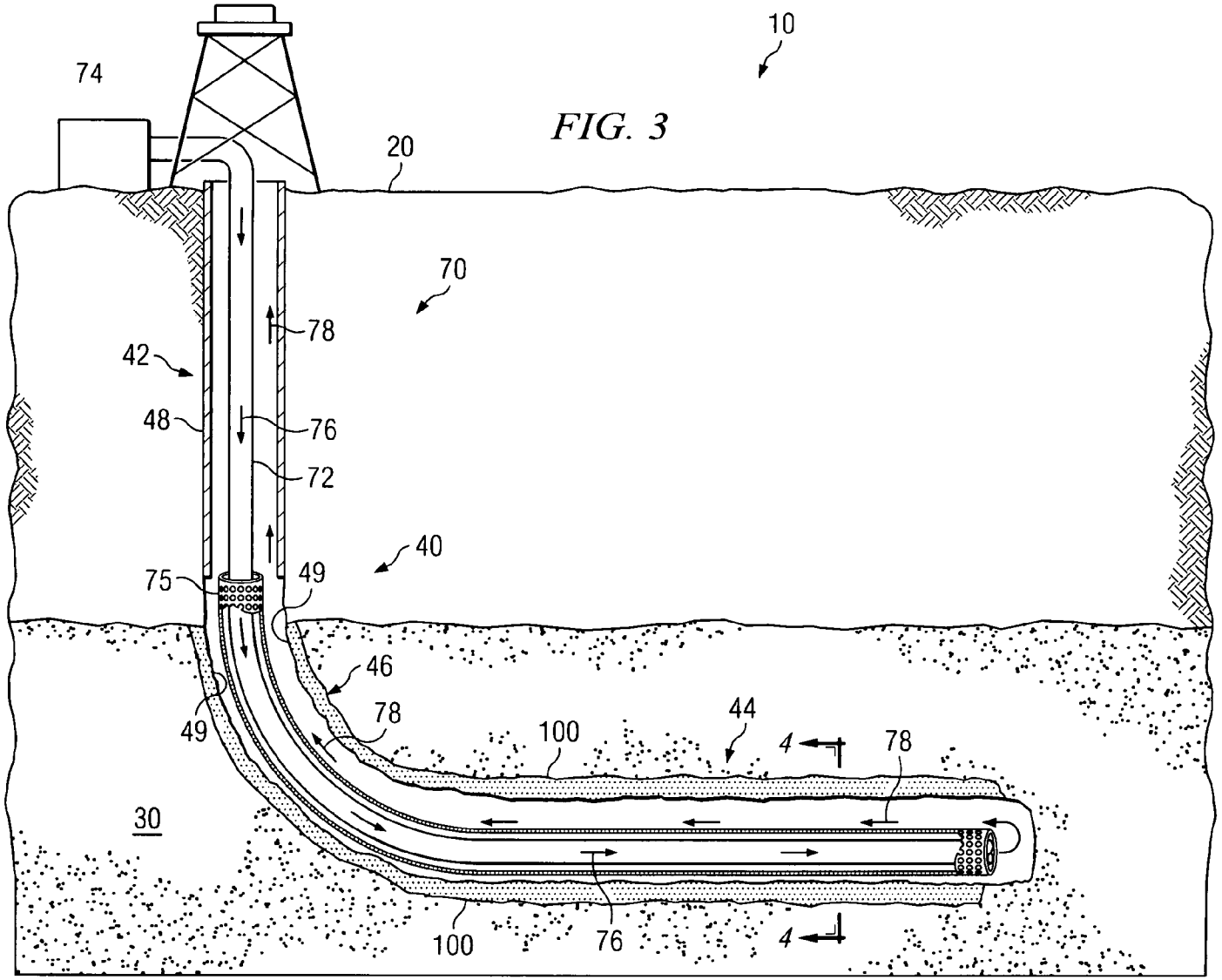
FIG. 3 illustrates one embodiment of completion of the well of FIG. 3.

FIG. 3 illustrates completion of example system 10. Drill string 50 has been removed and a fluid extraction system 70 inserted into well bore 40. Fluid extraction system 70 may include any appropriate components capable of circulating and/or removing fluid from well bore 40 and lowering the pressure within well bore 40. For example, fluid extraction system 70 may comprise a tubing string 72 coupled to a fluid movement apparatus 74. Fluid movement apparatus 74 may comprise any appropriate device for circulating and/or removing fluid from well bore 40, such as a pump or a fluid injector. Although fluid movement apparatus 74 is illustrated as being located on surface 20, in certain embodiments, fluid movement apparatus 74 may be located within well bore 40, such as would be the case if fluid movement apparatus 74 comprised a down-hole pump. The fluid may be a liquid and/or a gas.

In certain embodiments, fluid movement apparatus 72 may comprise a pump coupled to tubing string 72 that is operable to draw fluid from well bore 40 through tubing string 72 to surface 25 and reduce the pressure within well bore 40. In the illustrated embodiment, fluid movement apparatus 74 comprises a fluid injector, which may inject gas, liquid, or foam into well bore 40. Any suitable type of injection fluid may be used in conjunction with system 70. Examples of injection fluid may include, but are not limited to: (1) production gas, such as natural gas, (2) water, (3) air, and (4) any combination of production gas, water, air and/or treating foam. In particular embodiments, production gas, water, air, or any combination of these may be provided from a source outside of well bore 40. In other embodiments, gas recovered from well bore 40 may be used as the injection fluid by re-circulating the gas back into well bore 40. Rod, positive displacement and other pumps may be used. In these and other embodiments, a cavity may be formed in the well bore 40 in or proximate to curved portion 46 with the pump inlet positioned in the cavity. The cavity may form a junction with a vertical or other well in which the pump is disposed.

The fluid extraction system 70 may also include a liner 75. The liner 75 may be a perforated liner including a plurality of apertures and may be loose in the well bore or otherwise uncemented. The apertures may be holes, slots, or openings of any other suitable size and shape. The apertures may allow water and gas to enter into the liner 75 from the coal seal 30 for production to the surface. The liner 75 may be perforated when installed or may be perforated after installation. For example, the liner may comprise a drill or other string perforated after another use in well bore 40.

The size and/or shape of apertures in the liner 75 may in one embodiment be determined based on rock mechanics of the coal seam. In this embodiment, for example, a representative formation sample may be taken and tested in a tri-axial cell with pressures on all sides. During testing, pressure may be adjusted to simulate pressure in down-hole conditions. For example, pressure may be changed to simulate drilling conditions by increasing hydrostatic pressure on one side of the sample. Pressure may also be adjusted to simulate production conditions. During testing, water may be flowed through the formation sample to determine changes in permeability of the coal at the well bore in different conditions. The tests may provide permeability, solids flow and solids bridging information which may be used in sizing the slots, determining the periodicity of the slots, and determining the shape of the slots. Based on testing, if the coal fails in blocks without generating a large number of fines that can flow into the well bore, large perforations and/or high clearance liners with a loose fit may be used. High clearance liners may comprise liners one or more casing sizes smaller than a conventional liner for the hole size. The apertures may, in a particular embodiment, for example, be holes that are ½ inch in size.

In operation of the illustrated embodiment, fluid injector 74 injects a fluid, such as water or natural gas, into tubing string 72, as illustrated by arrows 76. The injection fluid travels through tubing string 72 and is injected into the liner 75 in the well bore 40, as illustrated by arrows 78. As the injection fluid flows through the liner 75 and annulus between liner 75 and tubing string 72, the injection fluid mixes with water, debris, and resources, such as natural gas, in well bore 40. Thus, the flow of injection fluid removes water and coal fines in conjunction with the resources. The mixture of injection fluid, water, debris, and resources is collected at a separator (not illustrated) that separates the resource from the injection fluid carrying the resource. Tubing string 72 and fuel injector 74 may be omitted in some embodiments. For example, if coal fines or other debris are not produced from the coal seam 30 into the liner 75, fluid injection may be omitted.

In certain embodiments, the separated fluid is re-circulated into well bore 40. In a particular embodiment, liquid, such as water, may be injected into well bore 40. Because liquid has a higher viscosity than air, liquid may pick up any potential obstructive material, such as debris in well bore 40, and remove such obstructive material from well bore 40. In another particular embodiment, air may be injected into well bore 40. Although certain types of injection fluids are described, any combination of air, water, and/or gas that are provided from an outside source and/or re-circulated from the separator may be injected back into well bore 40.

In certain embodiments, after drilling is completed, the drilling fluid may be left in well bore 40 while drill string 50 is removed and tubing string 72 and liner 75 are inserted. The drilling fluid, and possibly other fluids flowing from the coal seam 30, may be pumped or gas lifted (for example, using a fluid injector) to surface 20 to reduce, or "draw down," the pressure within well bore 40. As pressure is drawn down below reservoir pressure, fluid from the coal seam 30 may begin to flow into the well bore 40. This flow may wash out the filter cake 100 when non-invasive or other suitable drilling fluids are used. In other embodiments, the filter cake 100 may remain. In response to the initial reduction in pressure and/or friction reduction in pressure, the well bore 40 collapses, as described below. Collapse may occur before or after production begins. Collapse may be beneficial in situations where coal seam 30 has low permeability. However, coal seams 30 having other levels of permeability may also benefit from collapse. In certain embodiments, the drilling fluid may be removed before the pressure drop in well bore 40. In other embodiments, the pressure within well bore 40 may be reduced by removing the drilling fluid.

Figure 4:
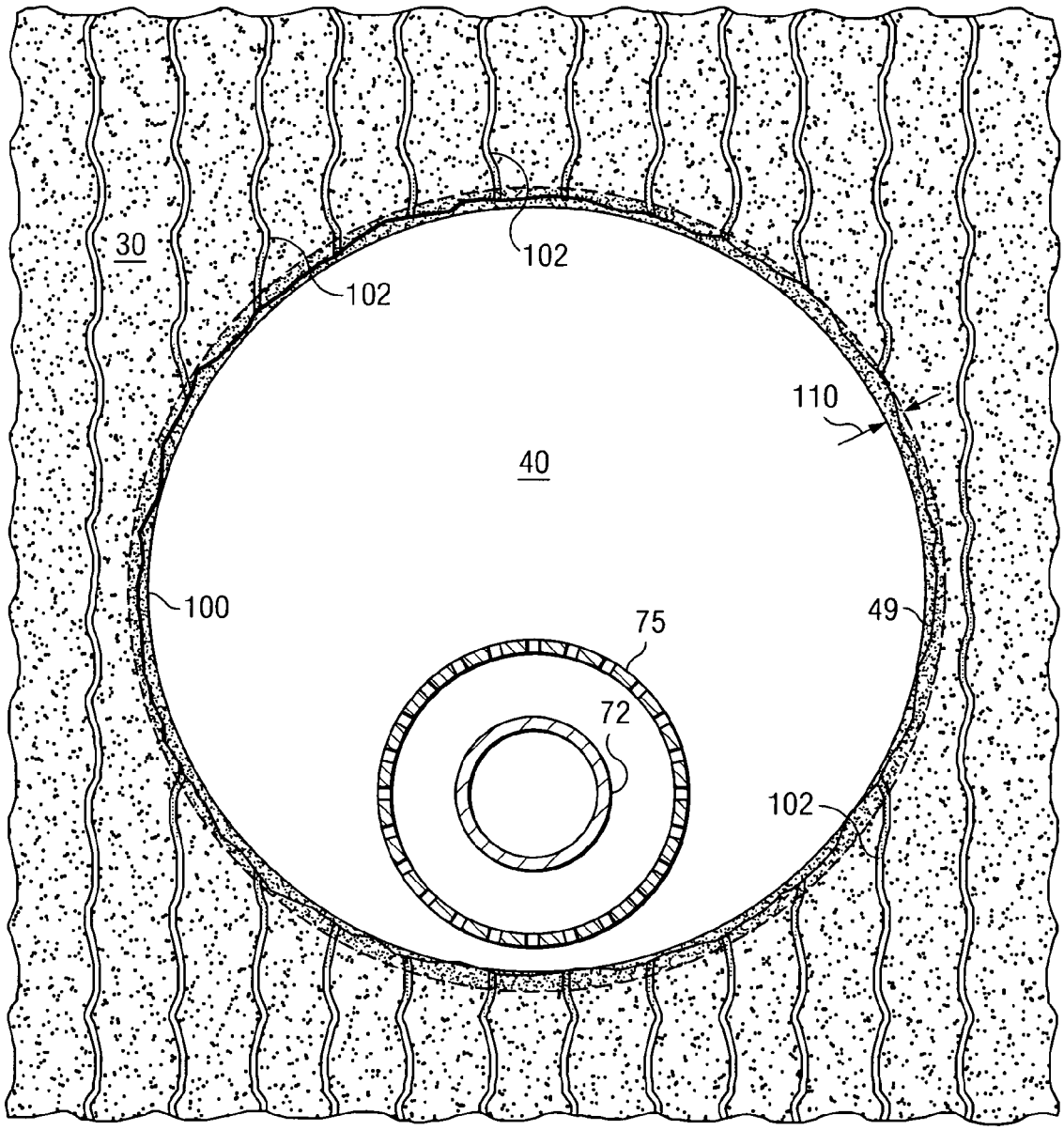
FIG. 4 is a cross sectional diagram illustrating one embodiment of the well bore of FIG. 1.

FIG. 4 is a cross sectional diagram along lines 4-7 of FIG. 3 illustrating well bore 40 in the subterranean zone 30. Filter cake 100 is formed along walls 49 of the well bore 40. As discussed above, filter cake 100 may occur in over-balanced drilling conditions where the drilling fluid pressure is greater that of the coal seam 30. Filter cake 100 may be otherwise suitably generated and may comprise any partial or full blockage of pores, cleats 102 or fractures in order to seal the well bore 40, which may include at least substantially limiting or reducing fluid flow between the coal seam 30 and well bore 40.

As previously described, use of a non-invasive fluid may create a relatively shallow filter cake 100, resulting in a relatively low amount of drilling fluid lost into the cleats 102 of the coal seam 30. In certain embodiments, a filter cake 100 may have depth 110 between two and four centimeters thick. A thin filter cake 100 may be advantageous because it will not cause a permanent blockage, yet strong enough to form a seal between coal seam 30 and well bore 40 to facilitate stability of the well bore 40 during drilling. Optimum properties of the filter cake 100 may be determined based on formation type, rock mechanics of the formation, formation pressure, drilling profile such as fluids and pressure and production profile.

Figure 5:
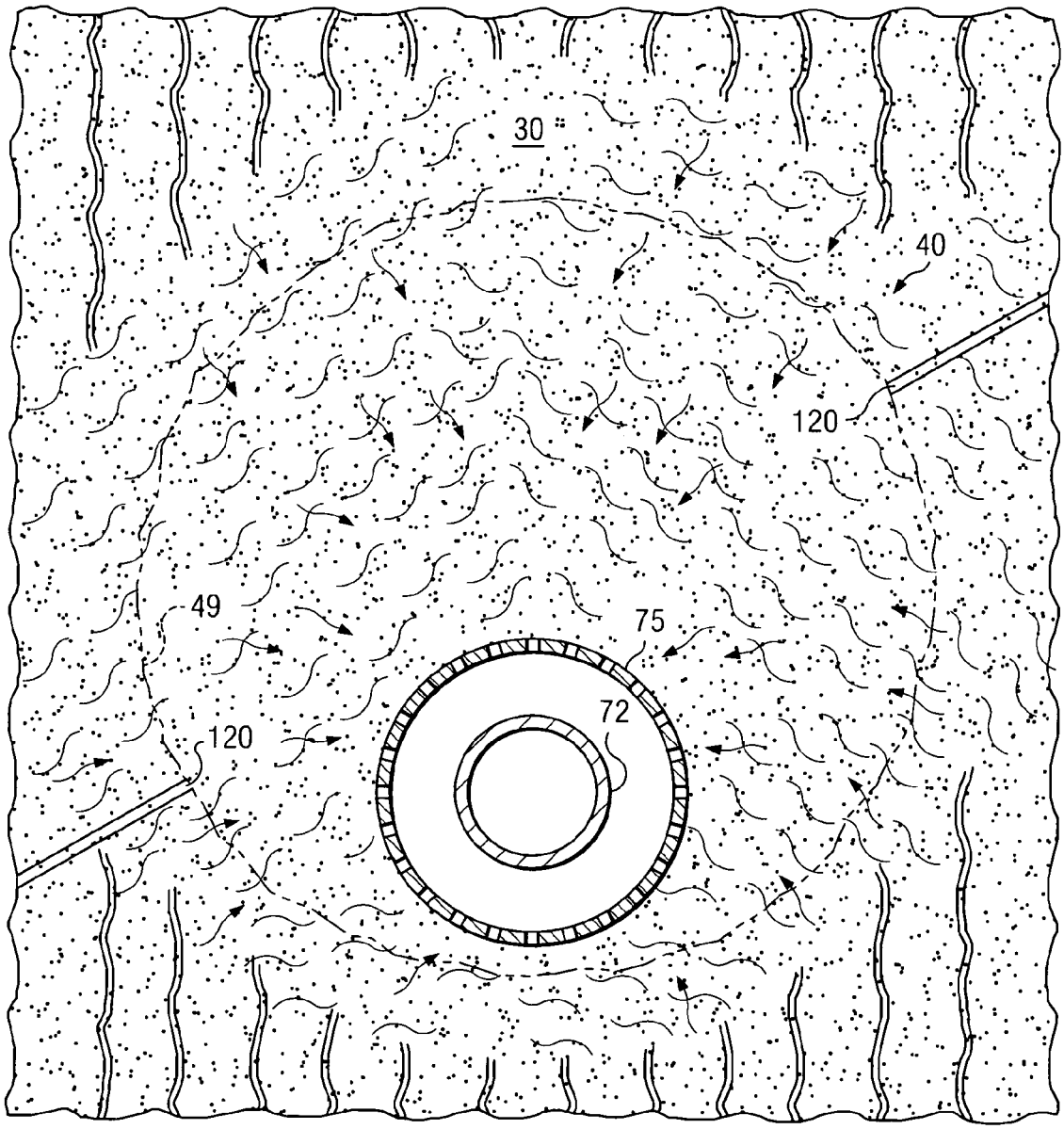
FIG. 5 is a cross-sectional diagram illustrating collapse of the well bore of FIG. 3.

FIG. 5 is a cross-sectional diagram illustrating collapse of the well bore 40. Collapse may be initiated in response to the pressure reduction. As used herein, in response to means in response to at least the identified event. Thus, one more events may intervene, be needed, or also be present. In one embodiment, the well bore 40 may collapse when the mechanical strength of the coal cannot support the overburden at the hydrostatic pressure in the well bore 40. The well bore 40 may collapse, for example, when pressure in the well bore 40 is 100-300 psi less than the coal seam 30.

During collapse, a shear plane 120 may be formed along the sides of the well bore 40. The shear planes 120 may extend into the coal seam 30 and form high permeability pathways connected to cleats 102. In some embodiments, multiple shear planes 120 may be formed during spalling. Each shear plane 120 may extend about the well bore 40.

Collapse may generate an area of high permeability within and around the pre-existing walls 49 of the well bore 40. This enhancement and localized permeability may permit a substantially improved flow of gas or other resources from the coal seam 30 into liner 75 than would have occurred without collapse. In an embodiment where the well bore 40 includes a multi-lateral pattern, the main horizontal bore and lateral bores may each be lined with liner 75 and collapsed by reducing hydrostatic pressure in the well bores.

Figure 6:
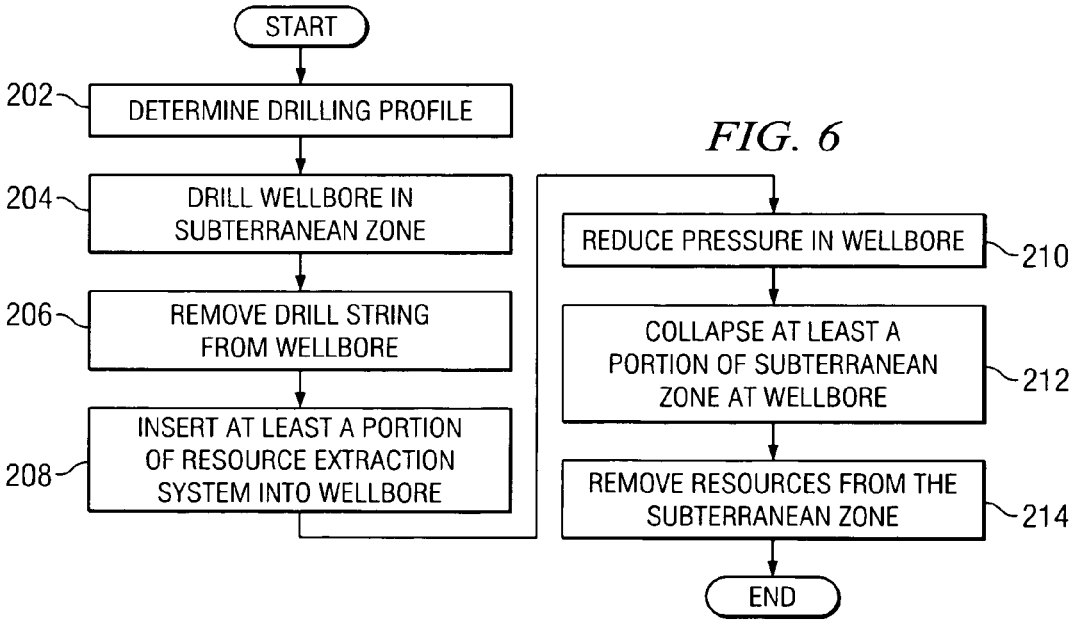
FIG. 6 is a flow chart illustrating an example method for forming a collapsed well bore in a subterranean zone.

FIG. 6 is a flow chart illustrating an example method for forming a collapsed well bore in a subterranean zone 30. The method begins at step 202, where a drilling profile is determined. The drilling profile may be determined based on the type, rock mechanics, pressure, and other characteristics of the coal seam 30. The drilling profile may comprise the size of the well bore 40, composition of the drilling fluid, the properties of the filter cake 100 and/or down-hole hydrostatic pressure in the well bore during drilling. The drilling fluid and hydrostatic pressure in the well bore 40 may be selected or otherwise determined to stabilize the well bore 40 during drilling while leaving a filter cake 100 that can be removed or that does not interfere with collapse or production. In a particular embodiment, the optimized filter cake may comprise a depth of approximately two to four centimeters with a structural integrity operable to seal the well bore 40. In a particular embodiment, the drilling fluid may comprise FLC 2000 manufactured by IMPACT SOLUTIONS GROUP which may create a shallow filter cake 100 and minimize drilling fluid losses into coal seam 30. The drilling profile may also include under, at, near or over balanced conditions at which the well bore 40 is drilled.

At step 204, the well bore 40 is drilled in the coal seam 30. As previously described, the well bore 40 may be drilled using the drill string 50 in connection with the drilling fluid determined at step 202. Drilling may be performed at the down-hole hydrostatic pressure determined at step 202. During drilling, the drilling fluid forms the filter cake 100 on the walls 49 of the well bore 40.

At step 206, the drill string 50 used to form well bore 40 is removed from well bore 40. At step 208, at least a portion of fluid extraction system 70 is inserted into well bore 40. As previously described, the fluid extraction system 70 may include a liner 75. In a particular embodiment, the drill string 50 may remain in the well bore and be perforated to form the liner 75. In this and other embodiments, ejection tube 72 may be omitted or may be run outside the perforated drill string.

At step 210, fluid extraction system 70 is used to pump out the drilling fluid in well bore 40 to reduce hydrostatic pressure. In an alternate embodiment of step 210, the pressure reduction may be created by using fluid extraction system 70 to inject a fluid into well bore 40 to force out the drilling fluid and/or other fluids. At step 212, the pressure reduction or other down-hole pressure condition causes collapse of at least a portion of the coal seam 30. Collapse increase the permeability of coal seam 30 at the well bore 40, thereby increasing resource production from coal seam 30. At step 214, fluid extraction system 70 is used to remove the fluids, such as water and methane, draining from coal seam 30.

Although an example method is illustrated, the present disclosure contemplates two or more steps taking place substantially simultaneously or in a different order. In addition, the present disclosure contemplates using methods with additional steps, fewer steps, or different steps, so long as the steps remain appropriate for subterranean zones.

Figure 7:
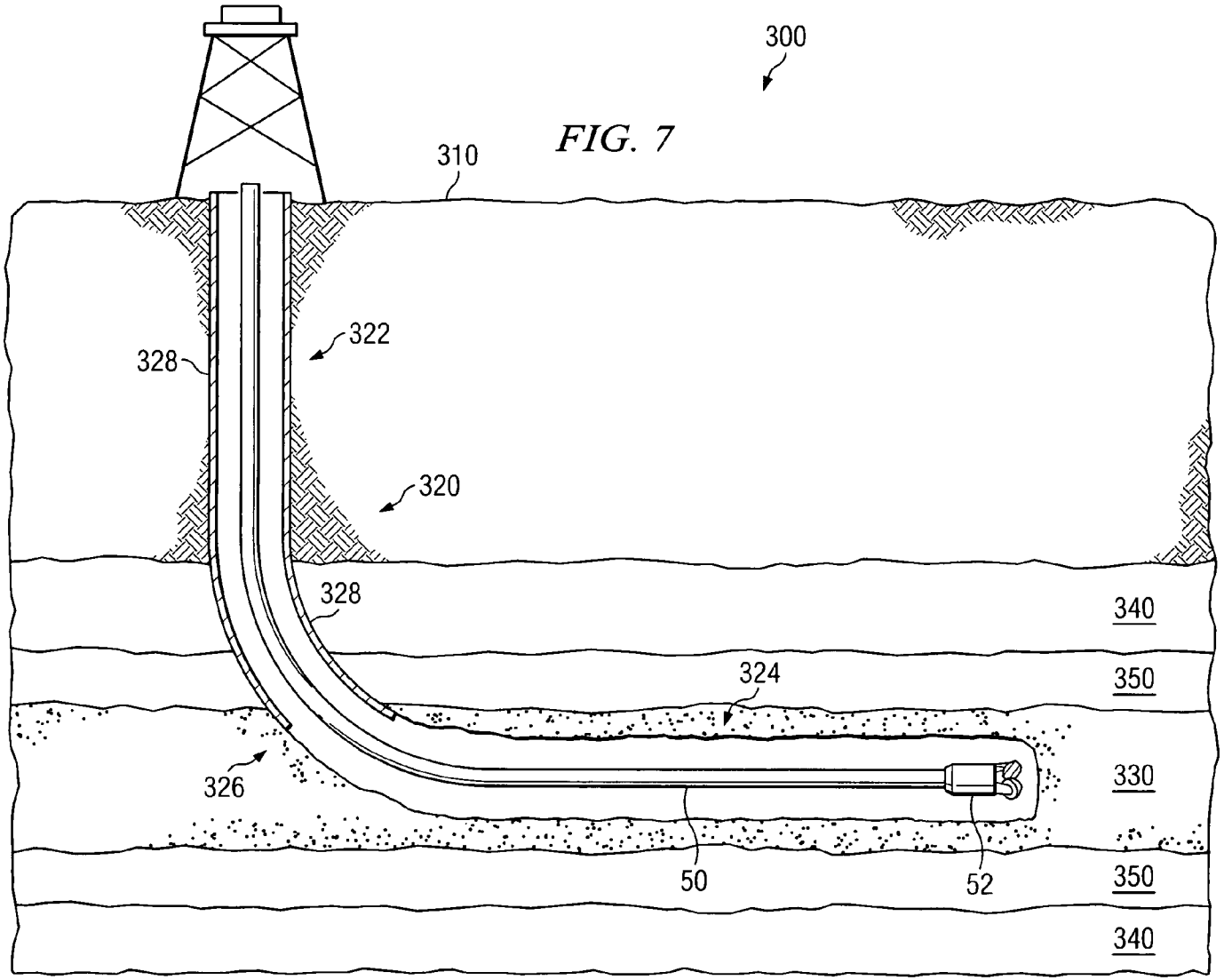
FIG. 7 illustrates an example system having a well bore that penetrates a subterranean zone proximate to one or more aquifers.

FIG. 7 illustrates an example well bore system 300 having a well bore 320 that penetrates a subterranean zone 330 proximate one or more aquifers 340. In certain embodiments, system 300 includes an articulated well bore 320 extending from surface 310 to penetrate subterranean zone 330 formed between two aquifers 340 and two relatively thin aquacludes and/or aquatards 350.

The articulated well bore 320 includes a substantially vertical portion 322, a substantially horizontal portion 324, and a curved or radiused portion 326 interconnecting the substantially vertical and substantially horizontal portions 322 and 324. The substantially horizontal portion 324 lies substantially in the plane of subterranean zone 330. Substantially vertical portion 322 and at least a portion of radiused portion 326 may be lined with a suitable casing 328 to prevent fluid contained within aquifer 340 and aquaclude and/or aquatards 350, through which well bore 320 is formed, from flowing into well bore 320. Articulated well bore 320 is formed using articulated drill string that includes a suitable down-hole motor and drill bit, such as drill string 50 and drill bit 52 of FIG. 1. Articulated well bore 320 may be completed and produced as described in connection with well bore 40.

In the illustrated embodiment, the subterranean zone is a coal seam 330. Subterranean zones, such as coal seam 330, may be accessed to remove and/or produce water, hydrocarbons, and other fluids in the subterranean zone. In certain embodiments, well bore 320 may be formed in a substantially similar manner to well bore 40, discussed above. The use of a horizontal well bore 320 in this circumstance may be advantageous because the horizontal well bore 320 has enough drainage surface area within subterranean zone 330 that hydraulic fracturing is not required. In contrast, if a vertical well bore was drilled into subterranean zone 330, fracturing may be required to create sufficient drainage surface area, thus creating a substantial or other risk that a fracture could propagate into the adjacent aquifers 340 and through aquacludes or aquatards 350.

The use of collapse may be beneficial for well bore 320 is drilled between two aquifers 340. As discussed above, collapse may be advantageous because it allows for the increase in drainage surface area of the coal seam 330, while avoiding the need to hydraulically fracture the coal seam 330. The increase in drainage surface area enhances production from the coal seam by allowing, for example, water and gas to more readily flow into well bore 320 for production to the surface 310. In a system such as system 300, hydraulically fracturing coal seam 330 to increase resource production may be undesirable because there is a substantial risk that a fracture could propagate vertically into the adjacent aquifers 340 and aquacludes or aquatards 350. This would cause the water in aquifers 340 to flow past the aquacludes or aquatards 350 and into coal seam 330, which would detrimentally affect the ability to reduce pressure in the coal seam and make it difficult to maintain a sufficient pressure differential for resource production.

Although the present disclosure has been described with several embodiments, various changes and modifications may be suggested to one skilled in the art. It is intended that the present invention encompasses such changes and modifications as fall within the scope of the appended claims.

What is claimed is:

1. A method for producing gas from a coal seam, comprising:

drilling a horizontal well bore in a coal seam using a non-invasive drilling fluid in an over-balanced drilling condition;

forming on the horizontal well bore with the non-invasive drilling fluid a filter cake having a depth of less than four centimeters;

inserting a liner into the horizontal well bore;

reducing a down-hole hydrostatic pressure in the horizontal well bore by removing fluid from the well bore;

collapsing the horizontal well bore around the liner; and producing fluids flowing from the coal into the horizontal well bore.

2. The method of claim 1, wherein the non-invasive drilling fluid comprises micelles.

3. The method of claim 1, wherein the liner is perforated.

4. The method of claim 1, wherein drilling a horizontal well bore comprises forming the horizontal well bore in a subterranean zone proximate one or more aquifers.

5. The method of claim 1, wherein the liner is uncemented.

6. A method for producing gas from a coal seam, comprising:

drilling a horizontal well bore in a coal seam using a non-invasive drilling fluid in an over-balanced drilling condition;

forming a filter cake on the horizontal well bore with the non-invasive drilling fluid;

inserting a liner into the horizontal well bore;

reducing a down-hole hydrostatic pressure in the horizontal well bore by removing fluid from the well bore;

collapsing the horizontal well bore around the liner; and producing fluids flowing from the coal scam into the horizontal well bore.

7. The method of claim 6, wherein the non-invasive drilling fluid comprises micelles.

8. The method of claim 6, wherein the liner is perforated.

9. The method of claim 6, wherein drilling a horizontal well bore comprises forming the horizontal well bore in a subterranean zone proximate one or more aquifers.

10. The method of claim 6, wherein the liner is uncemented.

* * * * *

UNITED STATES PATENT AND TRADEMARK OFFICE

CERTIFICATE OF CORRECTION

PATENT NO. : 7,419,223 B2
APPLICATION NO. : 11/035537
DATED : September 2, 2008
INVENTOR(S) : Douglas P. Seams It is certified that error appears in the above-identified patent and that said Letters Patent is hereby corrected as shown below:

Col. 8, in Claim 1 line 13, delete “coal into” and insert --coal seam into--, therefor.

Col. 10, in Claim 6 line 2, delete “scam” and insert --seam--, therefor.

Signed and Sealed this

Twenty-fifth Day of November, 2008

JON W. DUDAS
*Director of the United States Patent and Trademark Office*